US005896160A

United States Patent [19]

Katsuma et al.

[11] Patent Number: 5,896,160

[45] Date of Patent: Apr. 20, 1999

[54] THERMAL PRINTING METHOD AND THERMAL PRINTER

[75] Inventors: Nobuo Katsuma; Hisashi Enomoto, both of Saitama, Japan

[73] Assignee: Fuji Photo Film Co., Ltd., Kanagawa, Japan

[21] Appl. No.: 08/837,474

[22] Filed: Apr. 18, 1997

[30] Foreign Application Priority Data

Apr. 19, 1996 [JP] Japan ..... 8-098715
Mar. 28, 1997 [JP] Japan ..... 9-078292

[51] Int. Cl.[6] ..... B41J 2/36

[52] U.S. Cl. ..... 347/195; 347/184; 347/188; 400/120.09; 400/120.15

[58] Field of Search ..... 347/183, 184, 347/188, 189, 190, 191, 192, 194, 195, 196; 400/120.01, 120.09, 120.11, 120.12, 120.14, 120.15, 120.07

[56] References Cited

U.S. PATENT DOCUMENTS 5,115,252 5/1992 Sasaki ..... 347/195
5,153,605 10/1992 Ohara et al. ..... 347/184
5,528,276 6/1996 Katsuma ..... 347/191
5,546,113 8/1996 Izumi ..... 347/195
5,585,833 12/1996 Matumoto ..... 347/183
5,608,333 3/1997 Katsuma ..... 324/711
5,610,649 3/1997 Kokubo ..... 347/175

*Primary Examiner*—N. Le
*Assistant Examiner*—Anh T. N. Vo

[57] ABSTRACT

A thermal printer using a thermal head having a plurality of heating elements arranged in line, wherein the heating elements are driven for different power conduction times to record dots at different densities. According to the invention, the thermal printer is comprised of a first look-up table for converting original heating data into time data representative of a power conduction time corresponding to the original heating data; a correction circuit for correcting the time data to obtain a corrected power conduction time; a second look-up table for converting the corrected power conduction time into corrected heating data which corresponds to the corrected power conduction time; and a head driver for driving the heating elements in accordance with the corrected heating data.

21 Claims, 8 Drawing Sheets

THERMAL PRINTING METHOD AND THERMAL PRINTER

BACKGROUND OF THE INVENTION

1. Field of the Invention

The present invention relates to a thermal printing method and a thermal printer, wherein heating data for a thermal head is corrected with regard to resistance variation between heating elements of the thermal head, and heat accumulation in the thermal head. More particularly, the present invention relates to a thermal printer and a thermal printing method, wherein heating data is corrected after being converted into data representative of a driving or power conduction time of each individual heating element.

2. Background Arts

Sublimation transfer type or ink transfer type thermal printers and thermosensitive type or direct imaging type thermal printers have been known as printers which is capable of recording each dot at a different density to print an image with gradation. The former heats an ink film with a thermal head to transfer ink onto a recording sheet. The latter directly heats with a thermal head a thermosensitive recording sheet having a thermosensitive coloring layer per one color, to make the layer develop color. The thermal heads have a large number of heating elements aligned in a main scan direction. While the thermal head is moved relative to a recording sheet in a subscan direction perpendicular to the main scan direction, the heating elements are driven to record an image on a recording sheet one line after another. Each heating element is heated to record one dot in a pixel, i.e. one virtual square segment of the recording sheet. The heating energy of each heating element is controlled in accordance with heating data of each pixel, to change the density of the dot in accordance with a tonal level designated by the heating data. Hereinafter, heating data of each pixel will be referred to as pixel heating data.

For example, as shown in FIG. 10, when printing one dot on the thermosensitive recording sheet, one heating element first performs a bias heating by applying a bias heat energy Eb to the recording sheet to heat it up to such a degree above which a desired thermosensitive coloring layer begins to develop a color. Thus, the amount of bias heat energy Eb is determined by the heat sensitivity of the coloring layer. After this bias heating, a gradation heating for causing the coloring layer to color at a different density is performed by applying a different amount of gradation heat energy Eg to the recording sheet. With these bias heating and gradation heating, one pixel is colored to form one dot. The bias heat energy Eb and the gradation heat energy Eg are controlled in accordance with bias data and image data respectively. Accordingly, heating data for the thermosensitive type thermal printer consists of bias data and image data. On the other hand, heating data for the ink transfer type requires only to image data.

To control the amount of heat energy generated from the individual heating element in accordance with the pixel heating data assigned to that heating element, the amount of electric power supplied to each heating element is controlled. However, as shown for example in FIG. 10, the recording density is not proportional to the gradation heat energy Eg applied to the thermosensitive recording sheet. That is, the actual gradation of tonal levels is non-linear with respect to the gradation heat energy Eg, while the tonal levels represented by the image data are based on a linear gradation. Therefore, the pixel heating data is converted into time data representative of a driving or power conduction time through the heating element necessary for recording a dot at the designated density. This is because the heat energy generated from the heating element increases in direct proportion to the power conduction time through that heating element, as the heating elements are constructed of resistors. Conventionally, power conduction time through the heating element is controlled for each pixel by changing the time duration of one continuous driving or the number of times of intermittent driving in accordance with the heating data of that pixel.

It is also known in the field of thermal printing that the recording density is affected by heat energy accumulated in the individual heating elements as well as in the whole thermal head. The results are undesirable variation in density, inadequate contrast, so-called shading etc. As the heating elements are resistors, a variation in the resistance also results an unexpected variation in density. To prevent these problems, the heating data is corrected so as to eliminate the influence of heat accumulation and the resistance variation between the heating elements. Hereinafter, these correction processes of the heating data will be referred to as the correction due to the thermal head. Many methods for the correction due to the thermal head have been suggested, for example, in U.S. Pat. Nos. 5,528,276 and 5,608,333, and U.S. patent application Ser. Nos. 08/698,695 and 08/768,942.

Because of the non-linear relationship between the image data and the gradation heat energy, when correcting the heating data, for example, such that consequent gradation heat energy values are corrected by the same rate compared with the respective original values, it is necessary to multiply the image data of each tonal level by a different correction coefficient or factor. These different correction coefficients must be calculated from the value of image data, i.e. the original heat energy value, and the correction value of heat energy, in accordance with formulas that are determined based on the non-linear recording density curve of the thermosensitive coloring layer relating to heat energy, such as shown in FIG. 10. Such a calculation is complicated. Since this calculation should be done for each individual pixel of each line, and one line consists of a large number of pixels, it takes a certainly long data processing time or needs highly complicated operation circuits. In result, the total printing time is elongated, or the production cost of the thermal printer is increased.

SUMMARY OF THE INVENTION

In view of the above, an object of the present invention is to provide a thermal printer and a thermal printing method, whereby the correction due to the thermal head can be accomplished with ease.

To achieve the above object in a thermal printer using a thermal head having a plurality of heating elements arranged in line, wherein the heating elements are driven for different power conduction times to record dots at different densities. The present invention provides the thermal printer with a first look-up table for converting original heating data into time data representative of a power conduction time corresponding to the original heating data; a correction circuit for correcting the time data to obtain a corrected power conduction time; a second look-up table for converting the corrected power conduction time into corrected heating data which corresponds to the corrected power conduction time; and a head driver for driving the heating elements in accordance with the corrected heating data.

In a thermal printer using a thermal head having a plurality of heating elements arranged in line, wherein the heating elements are each individually driven in accordance with bias data for a constant bias heating time, and thereafter in accordance with image data for a variable gradation heating time for coloring the thermosensitive recording sheet up to a variable tonal level, the heating data, and includes the bias data and the image data both are corrected in the same way.

According to another embodiment of the present invention applicable to a thermosensitive recording type thermal printer, the thermal printer has a first look-up table for converting original image data into time data representative of a total power conduction time as a sum of the bias heating time and a gradation heating time corresponding to the original image data; a correction circuit for correcting the time data to obtain a corrected total power conduction time; a second look-up table for converting the corrected total power conduction time into corrected image data which corresponds to a corrected gradation heating time that is determined by a difference between the corrected total power conduction time and the bias heating time; and a head driver for driving the heating elements each individually for the bias heating time in accordance with the bias data and, thereafter, for the corrected gradation heating time in accordance with the corrected image data.

A thermal printing method according to the present invention, using a thermal head having a plurality of heating elements arranged in line, is comprised of the steps of:

assigning original heating data representative of a first tonal level to one of the heating elements;

converting the heating data into time data representative of a power conduction time corresponding to the first tonal level;

correcting the time data to obtain a corrected power conduction time;

converting the corrected power conduction time into corrected heating data which represents a second tonal level corresponding to the corrected power conduction time; and driving the one heating element for the corrected power conduction time by the corrected heating data.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The above and other objects and advantages of the present invention will become apparent from the following detailed description of the preferred embodiments when read in connection with the accompanying drawings, which are given by way of illustration only and thus are not limitative of the present invention, wherein like reference numerals designate like or corresponding parts throughout the several views, and wherein.

DETAILED DESCRIPTION OF THE PREFERRED EMBODIMENT

Figure 1:
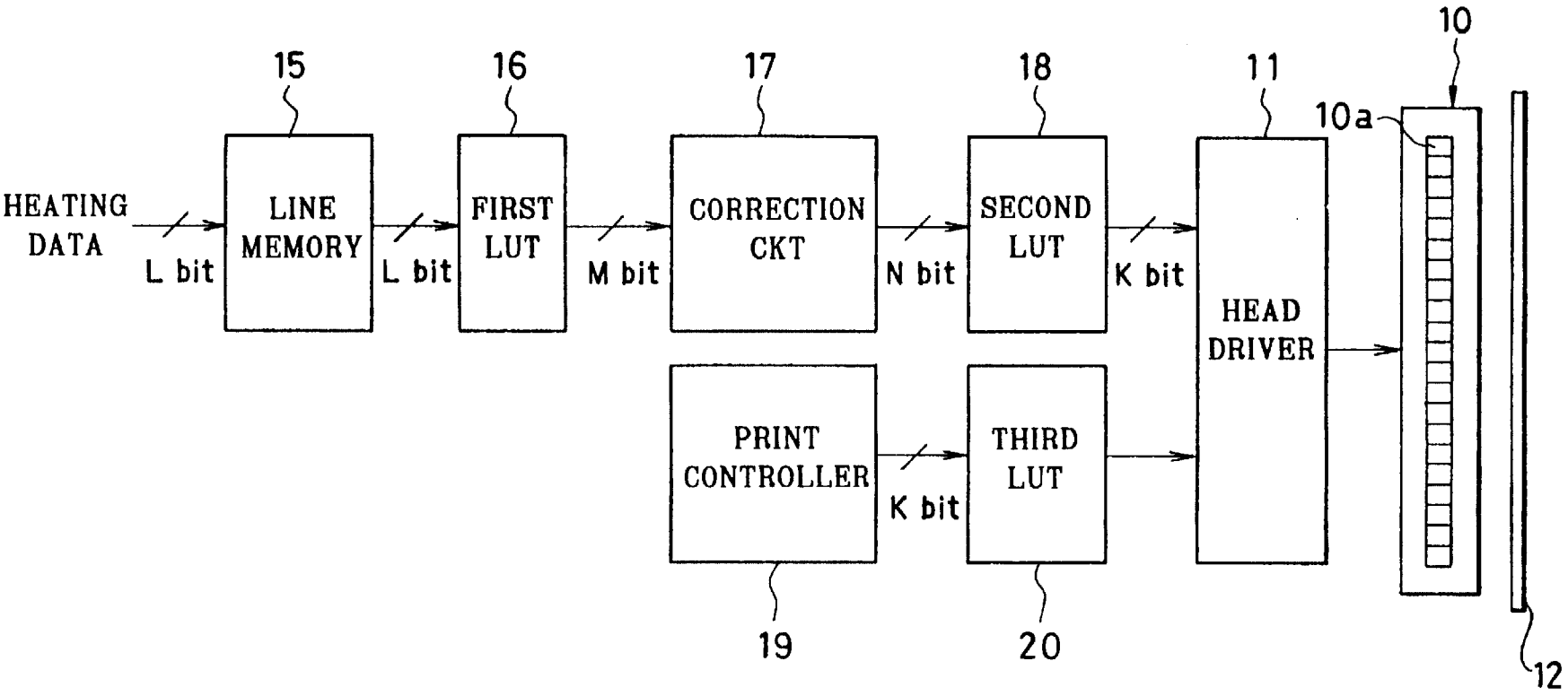
FIG. 1 is a schematic diagram illustrating essential parts of a thermal printer according to an embodiment of the present invention.
Figure 10:
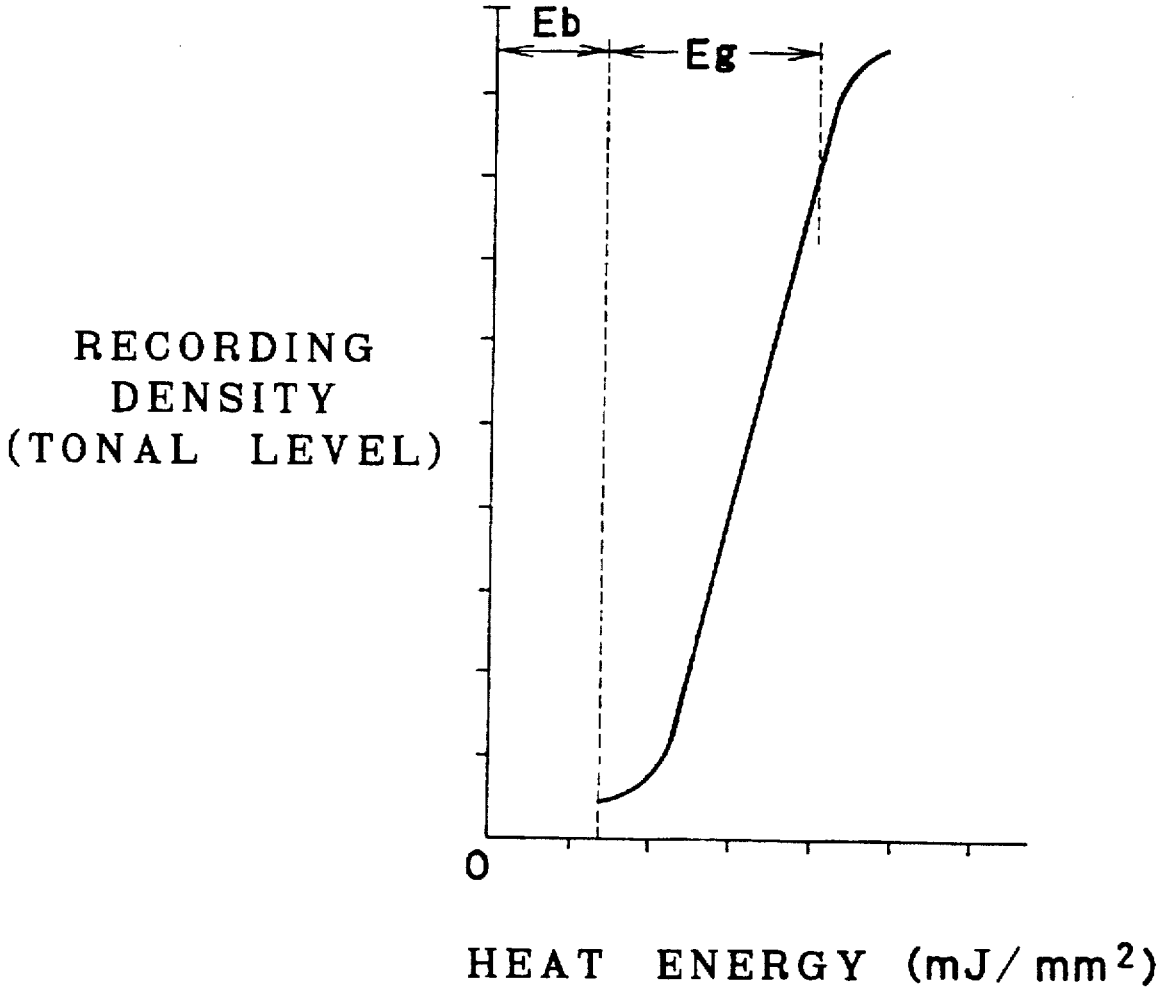
FIG. 10 (PRIOR ART)
FIG. 10 is a conventional recording density curve of a thermosensitive coloring layer of a thermosensitive recording sheet, relating to heat energy applied to the recording sheet.

In FIG. 1, a thermal head 10 has an array of heating elements 10*a* aligned in a main scan direction. The heating elements 10*a* are driven through a head driver 11, to record an image line by line on a thermosensitive recording sheet 12 while the recording sheet 12 contacts the thermal head 10 and is moved relative to the thermal head 10 in a sub-scan direction which is perpendicular to the main scan direction. The thermosensitive recording sheet 12 has at least a thermosensitive coloring layer, e.g. three coloring layers for color thermosensitive recording. The following description will relate to one coloring layer having coloring characteristics as shown in FIG. 10, though the same applies to each coloring layer.

When printing one line on the thermosensitive recording sheet 12, all of the heating elements 10*a* first perform a bias heating in response to bias data for one line, by which a desired thermosensitive coloring layer is about to develop a predetermined color. The amount of bias heat energy Eb is constant and determined by the heat sensitivity of the coloring layer. Therefore, the value of bias data is common to all heating elements 10*a*. After this bias heating, a gradation heating is performed by driving the heating elements 10*a* in accordance with image data, to apply different amounts of gradation heat energy Eg to the thermosensitive recording sheet 12. Accordingly, as for the thermosensitive recording, the heating data includes the bias data and the image data.

The heating data of one line to record is seriatim written in a line memory 15*a*. That is, the bias data for one line and then the image data for one line is alternately written in the line memory 15*a*, and is sent in serial from the line memory 15 to a first LUT 16. The first LUT 16 stores time data in association with each value of the heating data, so the heating data is converted into corresponding time data through the first LUT 16. The time data for one line is sent to a correction circuit 17.

In this embodiment, the heating data has L bits for one pixel. For example, the pixel heating data (heating data of one pixel) is 8-bit data. In that case, the value of the heating data ranges from "0" to "255" in decimal notation, so the image data can represent 256 tonal levels. Memory locations of the first LUT 16 are addressed with the heating data values "0" to "255". The time data written in each memory location of the first LUT 16 represents a power conduction time through the heating element 10*a* that is necessary for one gradation heating to obtain a tonal level corresponding to the data value used as the address of that location.

The power conduction times are predetermined in accordance with the coloring characteristics of the thermosensitive recording sheet 12. For instance, time data in address "1" of the first LUT 16 is representative of a power conduction time that is necessary for one gradation heating to color the thermosensitive recording sheet 12 at a density graded as the tonal level "1" of the 256 tonal levels represented by the image data. Time data in address "2" is representative of a power conduction time necessary for one gradation heating to record a dot at a density graded as the tonal level "2" of the 256 tonal levels.

Therefore, image data of one line is converted into time data for one line representative of individual power conduction times through the heating elements 10*a* for the gradation heating of that line. To the bias data, the same data processing sequence and thus the same power conduction method are applicable as to the image data, by predetermining the value of the bias data such that consequent bias heating energy is appropriate in view of the coloring characteristics of the thermosensitive recording sheet 12. Therefore, the present embodiment will now be described with respect to a case where the heating data to process is the image data.

Figure 2:
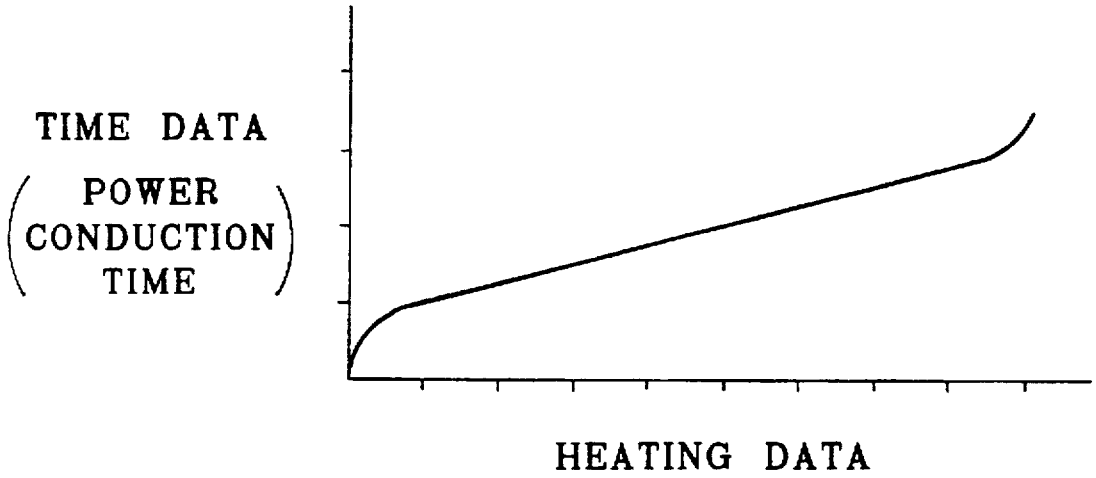
FIG. 2 is a graph illustrating a conversion curve from heating data to time data in the first LUT of FIG. 1.

FIG. 2 shows a conversion curve corresponding to the relationship between the heating data and the time data stored in the first LUT 16. The conversion curve shown in FIG. 2 is equal to an inverse function to the recording density curve as shown in FIG. 10. The time data of each pixel is M-bit data, M being more than L, e.g. M=16. This is because it is necessary to adjust the power conduction time more finely compared with the tonal levels represented by the image data.

The correction circuit 17 corrects the time data so as to eliminate the influence of heat accumulation and the influence of resistance variation between the heating elements 10*a*. For the correction to the heat accumulation, the correction circuit 17 estimates heat accumulation conditions in the individual heating elements 10*a* and global heat accumulation condition in the thermal head 10 on the basis of time data used for recording the past several lines and time data obtained from heating data of adjacent pixels and thus for the adjacent heating elements. Based on the estimated heat accumulation conditions, the correction circuit 17 determines correction coefficients to multiply the time data of the present recording line by the correction coefficients, and also filters the time data.

For the correction to the resistance variation, resistance correction coefficients for one line of time data are predetermined based on the respective resistance values of the heating elements 10*a* measured during the manufacture, and are stored in the correction circuit 17 in the factory. The correction circuit 17 multiplies the time data of the present recording line by the resistance correction coefficients. The correction circuit 17 may perform the correction by other methods or may make other kinds of correction, so far as the subject of correction is the time data. For example, the time data may be corrected in accordance with response characteristics of the thermal head 10, or may be corrected by subtraction.

Since the power conduction time through the heating element 10*a* is directly proportional to the heat energy generated from the heating element 10*a*, and the correction process is executed on the time data representative of the power conduction time, the correction circuit 17 can calculate correction coefficients for the respective pixels of different tonal levels based on the original heating energy values to be corrected by use of a simple or linear operation process. Thus, the correction circuit 17 can be simple, in comparison with the case where the heating data should be directly corrected by use of a conventional non-linear complicated operation process.

Through the correction in the correction circuit 17, the M-bit time data of each pixel is converted into corrected time data of N-bit, e.g. 24-bit, wherein N is larger than M, and is defined such that any corrected power conduction time can be efficiently represented by the corrected time data in accordance with the number of effective bits for the operation process. The corrected time data is sent to a second LUT 18.

The second LUT 18 stores corrected heating data. The corrected heating data of each pixel consists of K-bit, e.g. 10-bit, wherein K is larger than L (the bit number of the original pixel heating data), and is defined such that the corrected time data can be compressed to that length with no problem. The corrected heating data can be addressed by the corrected time data, so the corrected heating data for the present recording line is read out to be sent to the head driver 11. Of course, the head driver 11 is adapted to the bit number K of the corrected heating data. The corrected heating data represents a value for each pixel, by which the heating element 10*a* is driven for a corrected power conduction time.

Figure 3:
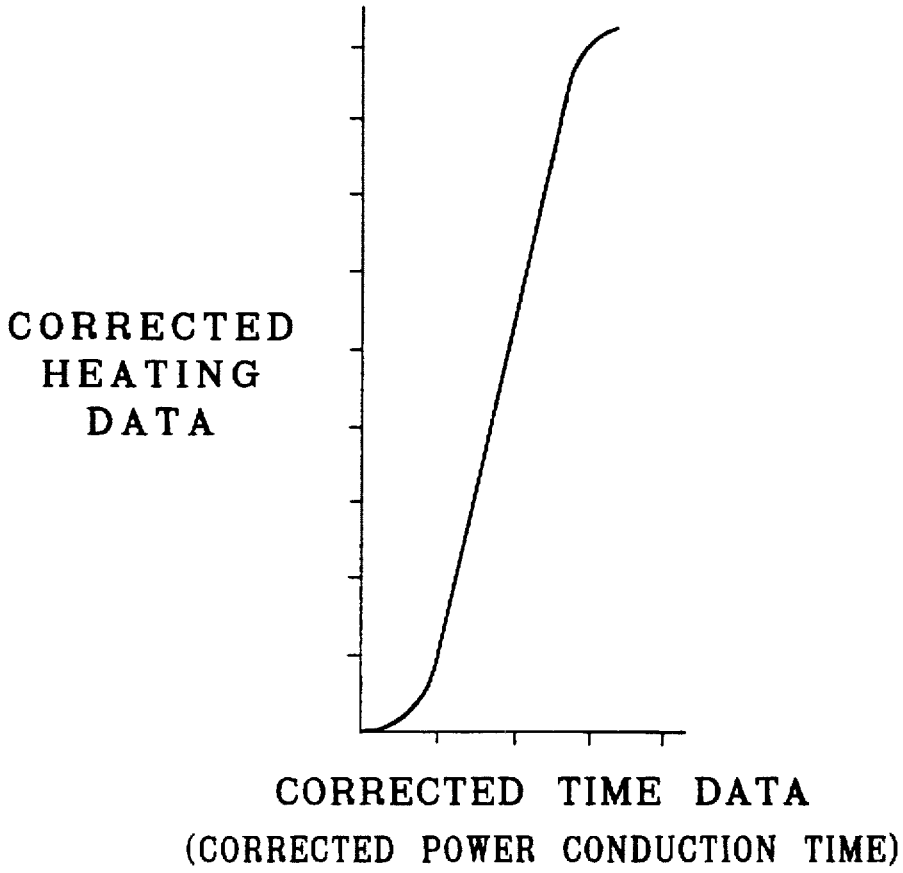
FIG. 3 is a graph illustrating a conversion curve in the second LUT of FIG. 1, that is inverse to the conversion curve of FIG. 2.

That is, the second LUT 18 converts the corrected time data into the corrected heating data in accordance with the conversion curve as shown in FIG. 3, which constitutes an inverse function to the conversion in the first LUT 16. Since the heating data is converted into the time data, and the corrected time data is converted into the corrected heating data, respectively by use of predetermined look-up tables, each data conversion is accomplished at a high speed.

A print controller 19 totally controls the thermal printer. The print controller 19 includes a counter. When the corrected heating data for one pixel is 10 bits, the value of the corrected heating data ranges from "0" to "1023" in decimal notation. That means, the image data after being corrected can represent 1024 tonal levels. In that case, the counter counts up from "1" to "1023" by an increment of "1" in a cyclic fashion, each cycle being for the heating data for one line. Each count of the counter is sequentially sent as 10-bit phase data to a third LUT 20, whose value ranges from "1" to "1023" in decimal notation. Thus, a series of phase data "1" to "1023" is sent to the third LUT 20 in a cyclic fashion. Hereinafter, the phase data "1" to "1023" will be referred to as the first to 1023d phase data respectively.

The third LUT 20 converts the first to 1023d phase data into a series of clock-interval data, hereinafter referred to as the first to 1023d clock-interval data respectively. The first to 1023d clock-interval data is sequentially sent to the head driver 11 in this order, while the head driver 11 is supplied with the corrected heating data of one line. Each clock-interval data represents a fractional power conduction time of varying length that constitutes one phase of power conduction through each heating element 10*a*.

As the necessary gradation heat energy gradually increases with an increase of the desired tonal level, the power conduction time for one gradation heating is elongated by one step or phase each time the tonal level steps up. Accordingly, the power conduction time for one gradation heating can be virtually sectioned into a number of fractions or successive gradation heating phases, the number being determined by the designated tonal level.

For instance, the power conduction time necessary for the gradation heating can be virtually sectioned into the first to third phases, each being for one increment of tonal level. The first to 1023d phase data respectively designate the first to the last phases of a maximum power conduction time that is necessary for a gradation heating up to the highest tonal level, i.e. the tonal level "1023" in this instance.

Since the relationship between the image data and the gradation heat energy is non-linear, the increment or decrement of gradation heat energy necessary for one increment or decrement of the tonal level varies depending upon whether the tonal level is in a higher density range, a middle density range or a lower density range. Therefore, the fractional power conduction time represented by the clock-interval data varies from one phase another, depending upon the corresponding tonal level, that is, in accordance with the corresponding phase data. The fractional power conduction times are determined in accordance with the non-linear recording density curve of the thermosensitive recording sheet 12 as shown in FIG. 10, more specifically, by the gradient of that curve.

Figure 4:
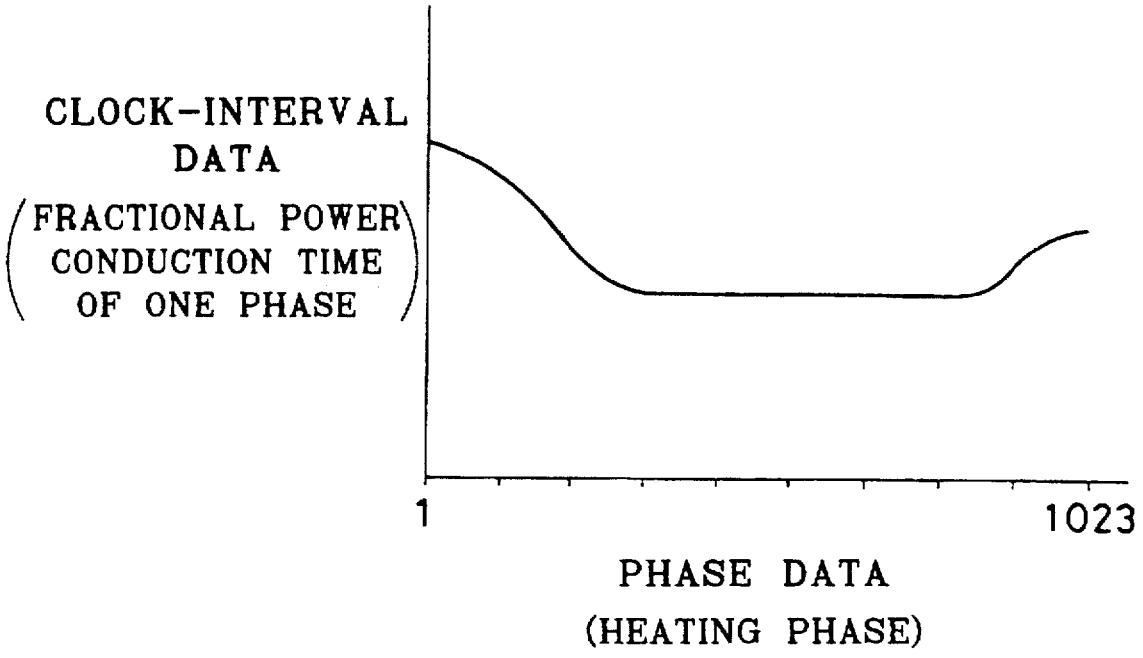
FIG. 4 is a graph illustrating a conversion curve from phase data to clock-interval data in the third LUT of FIG. 1.

Concretely, the third LUT 20 converts the phase data into the clock-interval data based on a conversion curve as shown in FIG. 4, which is formed by differentiating the conversion curve of FIG. 2 that is used in the first LUT 16. For instance, the first clock-interval data for the first phase data is representative of a fractional power conduction time specific to the first phase of gradation heating, by which a dot is recorded at a density graded as the tonal level "1" of the 1024 tonal levels. The second clock-interval data for the second phase data is representative of a fractional power conduction time specific to the second phase of gradation heating following the first phase of gradation heating.

For a gradation heating to record a dot at a density graded as the tonal level "2" of the 1024 tonal levels, the heating element 10*a* is driven for the first phase power conduction time plus the second phase power conduction time. In the same way, the third clock-interval data is representative of a fractional power conduction time specific to the third phase of gradation heating. To record a dot of the tonal level "3", the heating element 10*a* is driven for the third phase power conduction time in addition to the first and second phase power conduction times.

Figure 5:
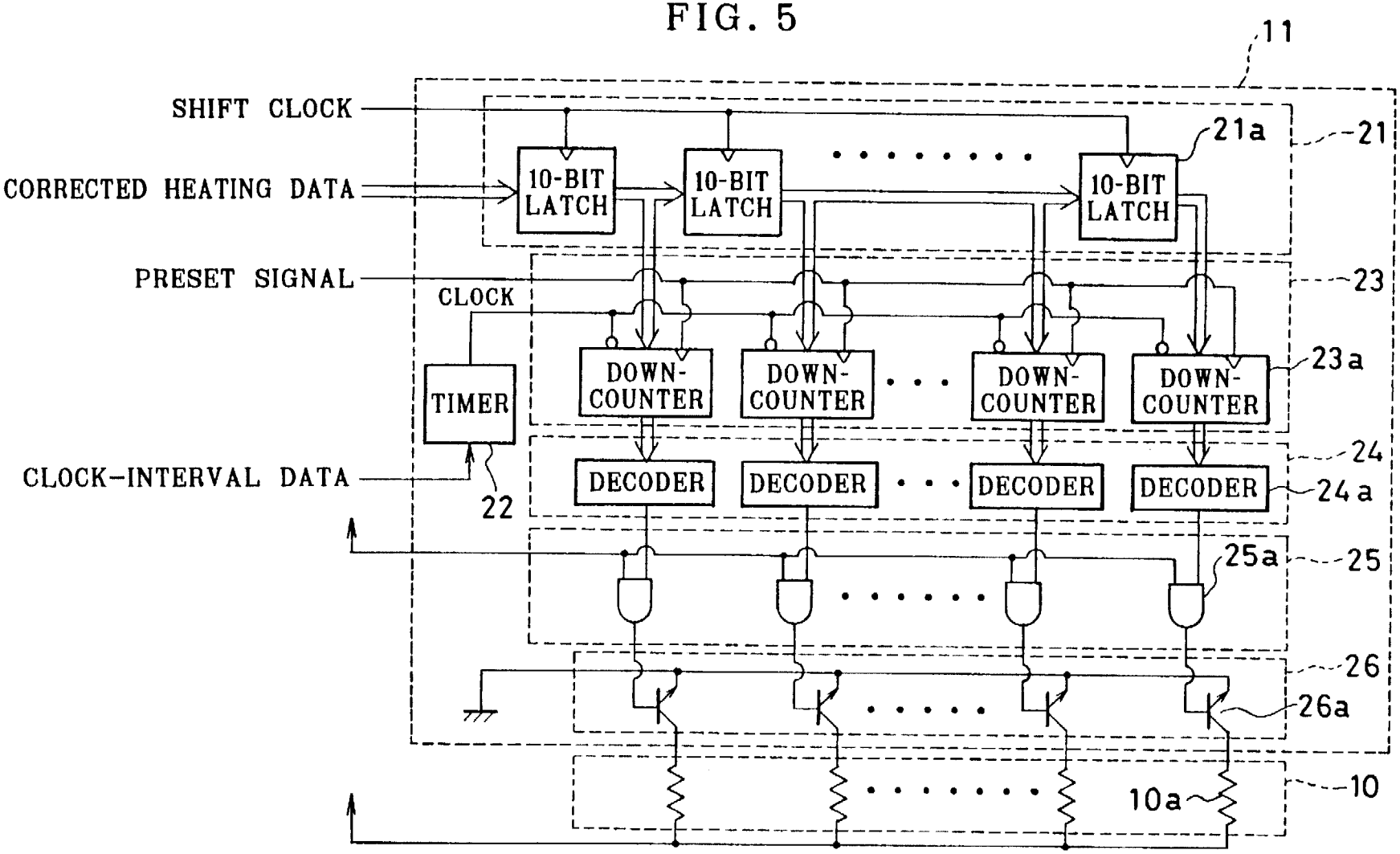
FIG. 5 is a circuit diagram of the head driver of FIG. 1.

As shown in FIG. 5, the head driver 11 has a shift register 21 which is constructed of an array of K-bit latches 21*a* connected in cascade, i.e. 10-bit latches in this instance. The number of the latches 21*a* is equal to the number of heating elements 10*a* of the thermal head 10. Each latch 21*a* is adapted to latch the corrected 10-bit pixel heating data, so that the shift register 21 latches the corrected heating data of one line supplied to the head driver 11 sequentially in the respective latches 21*a*. The head driver 11 further has a clock generator or timer 22, a counter array 23, a decoder array 24, a gate array 25, a switch array 26, and so forth. The counter array 23, the decoder array 24, the gate array 25 and the switch array 26 are respectively constructed of the same number of down-counters 23*a*, decoders 24*a*, AND-gates 25*a* and transistors 26*a* as the number of heating elements 10*a* of the thermal head 10.

The value of the corrected pixel heating data latched in one latch 21*a* is set in one of the down-counters 23*a* that is connected thereto. The down-counters 23*a* count from the set value down to zero by a decrement of "1" upon each receipt of one clock from the timer 22. Each down-counter 23*a* is connected to one of the decoders 24*a*. So long as the count of the individual down-counter 23*a* is not less than "1", the associated decoder 24*a* drives the associated heating element 10*a* through the associated AND-gates 25*a* and transistor 26*a*.

The timer 22 receives as a set value the first to 1023d clock-interval data one by one from the third LUT 20. The timer 22 outputs a clock to the down-counters 23*a* each time the fractional power conduction time represented by the clock-interval data set therein has elapsed. Since the down-counters 23*a* count down one by one upon each clock from the timer 22, each down-counter 23*a* counts down to zero in a varying time duration that is equal to the corrected power conduction time determined for the corrected pixel heating data set therein. In result, each associated heating element 10*a* is driven continuously for the corrected power conduction time, to generate heat energy of an amount corresponding to the corrected power conduction time.

Now, the operation of the above embodiment will be described. Heating data of one line to print at present is sequentially sent from the line memory 10 to the first LUT 16. In response to a first pixel heating data in the sequence of the one line, the first LUT 16 reads out time data from the location addressed by the value or tonal level of the first pixel heating data. Thus, the first pixel heating data is converted into the time data representative of a power conduction time necessary for a gradation heating to achieve this tonal level. In the same way, second and following pixel heating data of the one line is seriatim converted into time data in accordance with their values or tonal levels. The time data is sent to the correction circuit 17.

When the time data for the one line is entered, the correction circuit 17 derives data about heat accumulations in the individual heating elements 10*a* and in the thermal head 10 from the past time data used for the several preceding lines and the time data for the adjacent pixels. Based on the heat accumulation data, the correction circuit 17 calculates a correction coefficient for each pixel of the one line, and multiplies the time data for the one line by the corresponding correction coefficients, to eliminate the influence of heat accumulation. Thereafter, the correction circuit 17 multiplies the time data for the one line by the resistance correction coefficients predetermined for the respective heating elements 10*a*, to cancel the resistance variation between the heating elements 10*a*.

The time data thus corrected in the correction circuit 17 is sequentially sent to the second LUT 18. The second LUT 18 converts the corrected time data into correspondingly corrected heating data. The corrected heating data for the one line is sequentially sent to the head driver 11.

The corrected heating data of each pixel of the one line is shifted from one latch 21*a* to another at the timings of a shift clock signal, to be seriatim latched by the corresponding latches 21*a* of the shift register 21. The corrected heating data of each pixel latched in one latch 21*a* is set in the associated down-counter 23*a* in response to a preset signal. The shift clock signal and the preset signal are generated from the print controller 19. For those down-counters 23*a* where the value of the heating data set therein is not less than "1", the decoders 24*a* start driving the associated heating elements 10*a* through the associated AND-gates 25*a* and transistors 26*a*, synchronously with the preset signal. That is, for those down-counters 23*a* where the value of the heating data set therein is zero, the decoders 24*a* do not drive the associated heating elements 10*a*.

Meanwhile, the print controller 19 sends the first phase data to the third LUT 20 synchronously with the preset signal. Then the third LUT 20 reads out the first clock-interval data, and sets it in the timer circuit 22 of the head driver 11. The timer circuit 22 starts timing synchronously with the preset signal, and outputs a first clock to the respective down-counters 23*a* in the time represented by the first clock-interval data, i.e. when the power conduction time of the first phase has elapsed from the start of timing. In response to the first clock, the down-counters 23*a* count down by one.

In result, the counts of those down-counters 23*a* where the initial set value is "1" go down to zero, so that the power conduction through the associated heating elements 10*a* is terminated. For those down-counters 23*a* where the initial set value is more than "1", the associated heating elements 10*a* continue to be driven.

The print controller 19 sends the next, i.e. the second phase data to the third LUT 20 immediately after the timer circuit 22 outputs the first clock. The third LUT 20 then outputs the second clock-interval data to the timer circuit 22. The timer circuit 22 restarts timing each time it generates a clock. Therefore, the timer circuit 22 starts timing the power conduction time of the second phase that is represented by the second clock-interval data, immediately after generating the first clock. When the second phase power conduction time has elapsed since the first clock was generated at the end of the first phase, the timer circuit 22 outputs a second clock to the down-counters 23*a*. In result, those heating elements 10*a* being allotted the heating data value "2" are driven exactly for the first phase conduction time plus second phase conduction time. Those heating elements 10*a* being allotted the heating data values of more than "2" are kept being driven until the associated down-counter 23*a* counts down to zero responsive to following clocks generated from the timer 22.

As soon as the second clock is generated to terminate the second phase, the print controller 19 sends the next, i.e., the third phase data to the third LUT 20. Thus, the third clock-interval data is set in the timer 22, to generate a third clock to the down-counters 23*a* when the third phase power conduction time has elapsed since the second clock. The down-counters 23*a* count down by one upon receipt of the third clock, thereby terminating the third phase of power conduction. In the same way as for the first and second phases, the down-counters 23*a* count down one by one upon each receipt of the following clocks from the timer 22, so that the power conduction times through the heating elements 10*a* are controlled in accordance with the heating data assigned thereto.

When driving the heating elements 10*a* for a bias heating, original L-bit bias data for one line is written as the heating data in the line memory 15, and is processed in the same way as the described above with respect to the image data, so that the heating elements 10*a* are driven in accordance with corrected K-bit bias data through the head driver 11 in substantially the same way as described above. Therefore, a variation in bias heat energy due to the resistance variation between the heating elements 10*a* is eliminated. In this way, each line is recorded by a bias heating responsive to the bias data for one line and a gradation heating responsive to the image data for one line.

Although the above embodiment has been described with respect to a case where the heating elements 10*a* are continuously driven to record one line, it is possible to drive the heating elements 10*a* intermittently. In that case, the power conduction times for the respective tonal levels as well as for the respective phases should be adjusted so as to compensate for cooling of the heating elements 10*a* due to the intermission. Moreover, the above embodiment operates such that the heating element is not driven for gradation heating when the designated tonal level is "0", but it is, of course, possible to design the circuits such that any heating element is driven for a minimum gradation heating time, even when the lowest tonal level "0" is designed. In that case, the first phase data is assigned to the tonal level "0".

Figure 6:
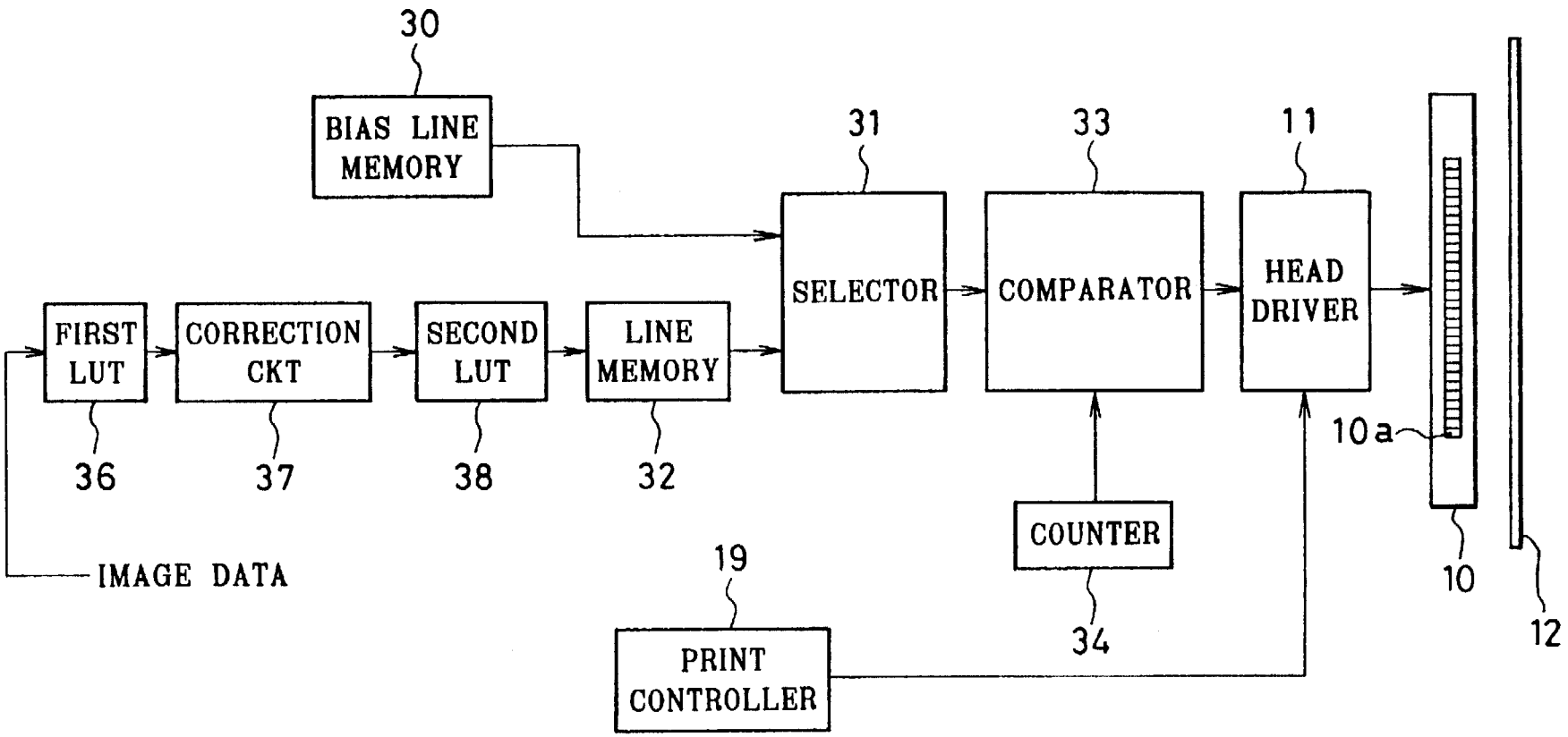
FIG. 6 is a schematic diagram illustrating essential parts of a thermal printer according to another embodiment of the present invention.

FIG. 6 shows a thermosensitive recording type thermal printer according to a second embodiment of the present invention, wherein image data is converted into total time data representative of a sum of a power conduction time necessary for a bias heating and a power conduction time necessary for a gradation heating up to a corresponding tonal level. Hereinafter, the time represented by the total time data will be referred to as a total power conduction time. The correction process is effected on the total time data and thus the total power conduction time. It is to be noted that the heating elements are driven intermittently in the second embodiment shown in FIGS. 6 to 9, but continuous driving is possible for the second embodiment. Moreover, the second embodiment operates such that any heating element is driven for a minimum gradation heating time even when the lowest tonal level is designated, but it is of course possible to design the second embodiment not to drive the heating element for gradation heating to the lowest tonal level.

In FIG. 6, a bias line memory 30 stores bias data for one line. For example, the bias data is 10-bit data per pixel, and has a value "639" in decimal notation. Responsive to the bias data, each heating element 10*a* is driven intermittently 640 times or in 640 intermittent phases of power conduction. The bias data is sent from the bias line memory 30 to a selector 31.

On the other hand, image data is sent to a first LUT 36. For example, the image data is 8-bit data per pixel whose value ranges from "0" to "255", so that it can represent 256 tonal levels. The first LUT 36 converts the image data into corresponding total time data in accordance with a conversion curve shown in FIG. 7. The conversion curve of FIG. 7 is similar to the conversion curve of FIG. 2, the inverse function of the recording density curve of a thermosensitive recording sheet 12 as shown in FIG. 10, but is different from that as including a constant power conduction time for bias heating, hereinafter referred to as the bias heating time.

Accordingly, the total conduction time for each tonal level is a sum of the constant bias heating time and a variable power conduction time which is necessary for generating a gradation heating energy to record a dot of the designated tonal level, hereinafter referred to as a gradation heating time. The gradation heating time is determined for each tonal level in accordance with the recording density curve of a thermosensitive recording sheet 12 as shown in FIG. 10.

A correction circuit 37 effects a similar correction process to that of the above embodiment for the total time data for one line and is based on past total time data used for the several preceding lines and total time data obtained from image data of adjacent pixels. Thus, the total conduction times for the respective heating elements 10*a* are corrected with values necessary for the bias heating and those for the gradation heating. The correction circuit 37 sends corrected total time data representative of the corrected total conduction times for one line to a second LUT 38.

Figure 7:
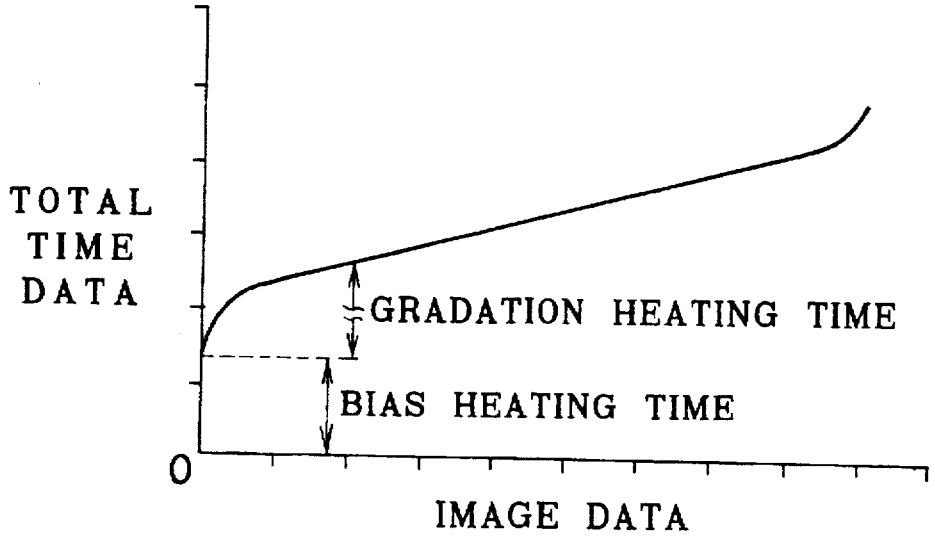
FIG. 7 is a graph illustrating a conversion curve from image data to total time data in the first LUT of FIG. 6.
Figure 8:
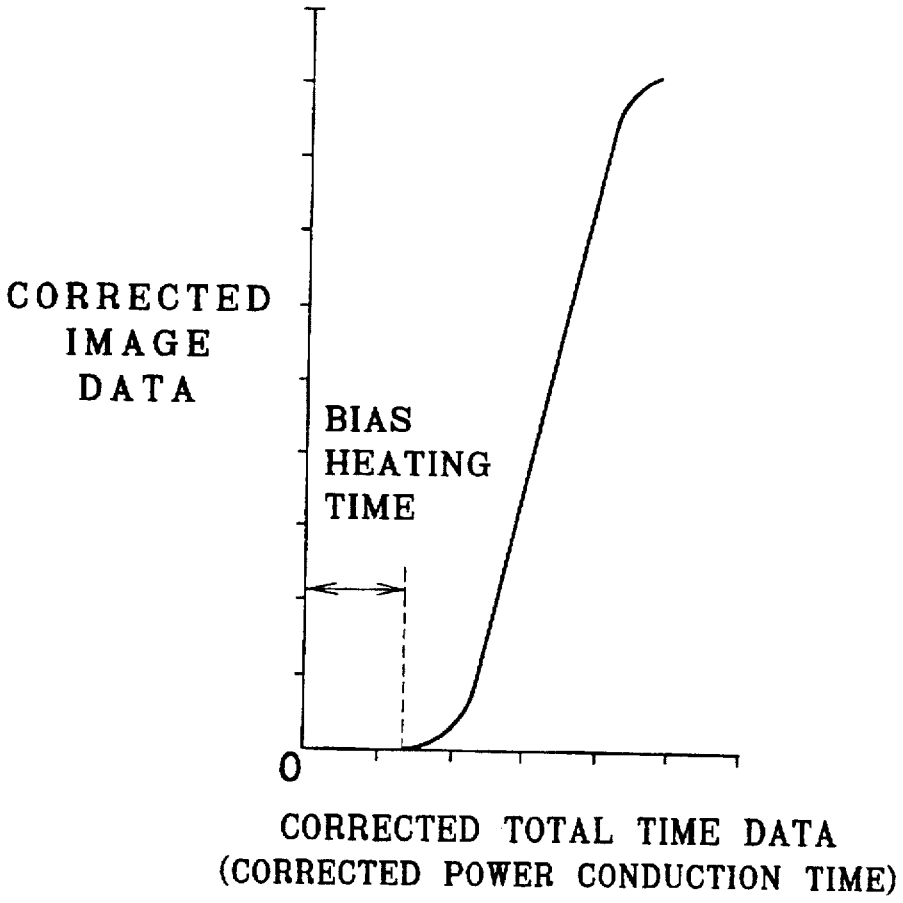
FIG. 8 is a graph-illustrating a conversion curve in the second LUT of FIG. 6, that is inverse to the conversion curve of FIG. 7.

The second LUT 38 converts the corrected total time data into corrected image data in accordance with a conversion curve as shown in FIG. 8, which constitutes an inverse function to the conversion curve of FIG. 7. Accordingly, the corrected image data for one pixel has a value corresponding to a gradation heating time that is obtained by subtracting the constant bias heating time from the corrected total conduction time obtained for that pixel.

The corrected image data for one line is written in a line memory 32. To record one line, the selector 31 first connects the bias line memory 30 to a comparator 33, so that the bias data for one line is sequentially sent to the comparator 33. After the bias data for one line is completely sent to the comparator 33, the selector 31 connects the line memory 32 to the comparator 33, to send the corrected image data for one line to the comparator 33.

A counter 34 outputs a series of comparison data whose value ranges from "0" to "639" in decimal notation to the comparator 33, while the bias data is applied to the comparator 33. The counter 34 outputs another series of comparison data whose value ranges from "0" to "255" to the comparator 33, while the corrected image data is applied to the comparator 33. The comparator 33 sequentially compares the bias data of each pixel of one line and the corrected image data of each pixel of one line with each value of the comparison data, and outputs a binary "1" or "0" for each pixel of one line depending upon whether the bias or image data is not less than the comparison data, or is less than the comparison data. The binary values for one line obtained at each comparison of the bias or image data of one line with one comparison data value is sent in serial to a head driver 11.

Thus, the bias data for one line is compared 640 times with the comparison data "0" to "639". As a result, the bias data is converted into 640 x 1-bit bias drive data for each pixel of one line. Thereafter, the corrected image data for one line is compared 256 times with the comparison data "0" to "255", generating 256 x 1-bit gradation drive data for each pixel of one line. In other words, the binary values for one line obtained by the comparison with the comparison data "0" constitute the first drive data of one line.

Figure 9:
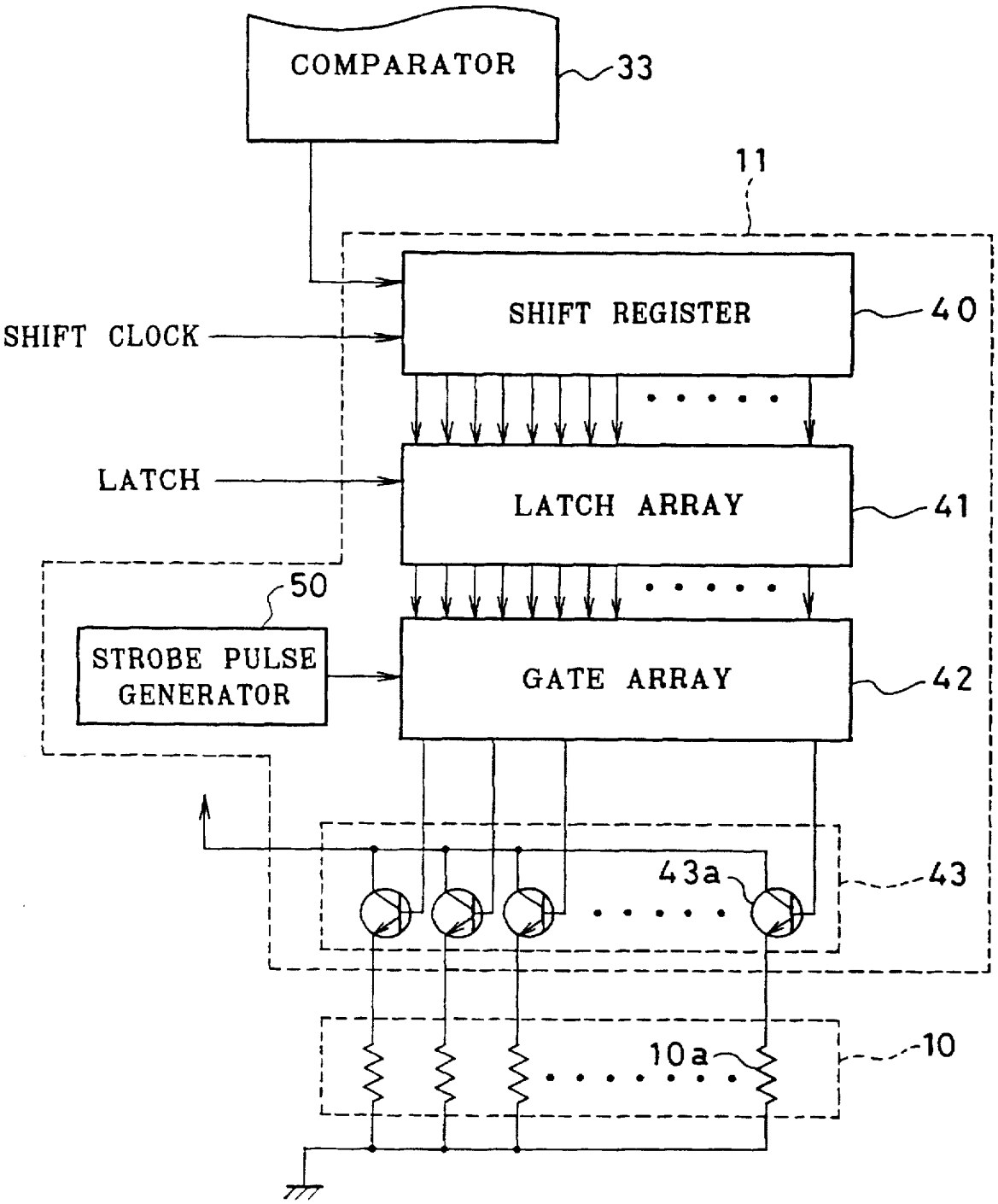
FIG. 9 is a block diagram of the head driver of FIG. 6.

As shown in FIG. 9, the head driver 11 is constructed of a shift register 40, a latch array 41, a gate array 42 and a switch array 43. The shift register 40 receives the serial binary values as the drive data from the comparator 33 and shifts them one by one synchronously with a shift clock signal, to output the binary values for one line in parallel to the latch array 41. The latch array 41 latches the drive data for one line and outputs them to the gate array 42 synchronously with a latch signal. The gate array 42 produces a logical product of each binary value of the drive data and a strobe pulse from a strobe pulse generator 50. For the drive data of binary "1", therefore, a drive pulse having the same width as the strobe pulse is generated. For the drive data of binary "0", no drive pulse is generated. The drive pulses are applied in parallel to the switch array 43. The shift clock signal and the latch signal are generated from a print controller 19.

The switch array 43 is constructed of a plurality of transistors 43*a*, each being connected to one heating element 10*a*. The transistor 43*a* is turned on so long as the drive pulse is applied thereto, so that the associated heating element 10*a* is driven for a time determined by the width of the strobe pulse when the binary value of the drive data is "1".

The strobe pulse generator 50 sequentially generates 1024 strobe pulses with varying width for recording one line, of which the first to 640th strobe pulses are for bias heating, and the 641st to 896th strobe pulses are for gradation heating. The sum of the pulse widths of the first 640 strobe pulses for bias heating is equal to the constant bias heating time. The pulse width of each of the 641st to 896th strobe pulses is to define a different power conduction time which is necessary for one increment of the tonal level. The sum of the pulse widths of these 256 strobe pulses for gradation heating is equal to a maximum gradation heating time necessary for the highest tonal level "255". The 897th to 1024th strobe pulses are for use in over-shoot heating which is a method of edge enhancement by supplying an extreme amount of heat energy in a portion where the density should jump up from a low level to a high level. The pulse widths of the strobe pulses for gradation heating are determined in accordance with the gradient of the non-linear recording density curve of the thermosensitive recording sheet 12 as shown in FIG. 10. Therefore, the pulse widths of the strobe pulses for gradation heating correspond to the fractional power conduction times of the gradation heating phases in the first embodiment.

Now the operation of the second embodiment will be briefly described. To record one line, first the bias data for one line is sent from the bias line memory 30 to the comparator 33, while the counter 34 sequentially sends the comparison data "0" to "639" to the comparator 33. Since the bias data always has the value "639", the comparator 33 generates 640 times 1-bit bias drive data of binary "1" for each pixel of one line. Synchronously with the bias drive data, the strobe pulse generator 50 sequentially outputs the first to 640th strobe pulses to the gate array 42, so that all the heating elements 10*a* are driven 640 times by 640 drive pulses simultaneously with each other. In result, the bias heat energy corresponding to the constant bias heating time is generated from each heating elements 10*a*. Because the bias heating time is constant, the bias heat energy applied to the thermosensitive recording sheet 12 is influenced by the heat accumulation and the resistance variation of the heating elements 10*a*.

While the bias heating is carried out, image data of the one line to print is sent to the first LUT 36, to be converted into total time data. The total time data for one line is sent to the correction circuit 17. For example, image data having a value "180" is converted into total time data representative of a total conduction time as the sum of the constant bias heating time and a gradation heating time for the tonal level "180". The gradation heating time for the tonal level "180" is equal to the sum of the pulse widths of the 641st to 821st strobe pulses.

The correction circuit 37 effects the correction due to the thermal head 10 onto the total time data for one line, to produce corrected total time data for one line. The corrected total time data for one line is sequentially sent to the second LUT 38. The second LUT 38 converts the corrected total time data into corrected image data for each pixel in correspondence with a gradation heating time that is obtained by subtracting the constant bias heating time from a corrected total conduction time represented by the corrected total time data. For example, if the total time data for one pixel whose original image data designates the tonal level "180" is transformed through the correction circuit 37 into corrected total time data that represents a total power conduction time necessary for the tonal level "146", the consequent corrected image data has the value "146". The corrected image data for one line is stored in the line memory 32.

After the bias heating for the one line, the selector 31 is switched to the line memory 32, and the counter 34 is reset to zero, restarting counting from "0" up to "255". Then the corrected image data of each pixel of the one line is seriatim compared with the comparison data "0", so that the comparator 33 outputs gradation drive data of binary "1" for all pixels, because all image data is not less than "0". The drive data from the comparator 33 is sent in serial to the shift register 40 of the head driver 11, and the shift register 40 outputs the drive data for one line in parallel to the latch array 41. Next, the corrected image data of each pixel of the one line is seriatim compared with the comparison data "1", so that the comparator 33 outputs gradation drive data of binary "1" for those pixels whose corrected image data has a decimal value of not less than "1", and gradation drive data of binary "0" for those pixels whose corrected image data is "0". In the same way, the corrected image data of each pixel of the one line is compared with the comparison data "2" to "255", and the comparator 33 outputs gradation drive data of binary "1" when the image data is not less than the comparison data, or binary "0" when the image data is less than the comparison data.

The drive data from the comparator 33 is sent in serial to the shift register 40 of the head driver 11, and the shift register 40 outputs the drive data for one line in parallel to the latch array 41.

When the drive data for one line is latched by the latch array 41, then the strobe pulse generator 50 outputs the 641st strobe pulse to the gate array 42. For those pixels which the drive data "1" is assigned to, drive pulses having the same width as the 641st strobe pulse are applied to the associated transistors 43*a* of the switch array 43. For those pixels which the drive data "0" is assigned to, a drive pulse is not applied to the associated transistors 43*a* of the switch array 43.

In this way, the corrected image data of the one line is seriatim compared with each of the comparison data "0" to "255", to output 1-bit drive data for each pixel of one line at each comparison. As a result, following the 640 drive pulses for the bias heating, at most 256 drive pulses are applied to one heating element 10*a* for the gradation heating in correspondence with the corrected image data of each pixel, and the widths of these 256 drive pulses for the gradation heating are defined by the 641st to 896th strobe pulses respectively. Thereafter, the 897th to 1024th strobe pulses are generated, to terminate the recording of one line.

In this way, each heating element 10*a* is driven for a corrected total power conduction time that is represented by the corrected total time data obtained from the corrected image data assigned thereto. Thus, each heating element 10*a* generates the constant bias heat energy and a gradation heat energy whose value is corrected so as to eliminate the influence of the heat accumulation and the resistance variation on the bias heating, as well as the influence on the gradation heating.

Although the above embodiments have been described with respect to the thermosensitive type thermal printing, the present invention is applicable to the sublimation ink transfer type thermal printing. The present invention is also applicable to a serial printer wherein a thermal head moves in a direction while the recording sheet moves in the perpendicular direction. The correction process in the correction circuit 17 may be performed by a CPU or a circuit having a digital signal processor and logic circuits. Of course, the present invention is applicable to color thermal printers.

Thus, the present invention should not be limited to the above described embodiments but, on the contrary, various modification may be possible to those skilled in the art without departing from the scope of claims attached hereto.

What is claimed is:

1. A thermal printing method using a thermal head having a plurality of heating elements arranged in line, wherein the heating elements are resistors 5 which generate heat energy increasing in proportion to a power conduction time therethrough, and are driven for different power conduction times to record dots at different densities, the method comprising the steps of:

A. assigning original heating data representative of a first tonal level to one of the heating elements;

B. converting said heating data into time data representative of the power conduction time corresponding to said first tonal level;

C. correcting said time data to obtain a corrected power conduction time;

D. converting said corrected power conduction time into corrected heating data which represents a second tonal level corresponding to said corrected power conduction time; and E. driving said one heating element for said corrected power conduction time by said corrected heating data.

2. The thermal printing method as claimed in claim 1, wherein said time data is corrected in step C by use of time data obtained from previous heating data and from adjacent heating data, so as to eliminate influence of heat accumulation in the heating elements on a recording density.

3. The thermal printing method as claimed in claim 1, wherein said time data is corrected in step C on a basis of resistance values of the heating elements, so as to eliminate influence of a resistance variation between the heating elements.

4. The thermal printing method as claimed in claim 1, wherein said original heating data is converted into said time data in step B in accordance with a non-linear conversion curve which is determined by a non-linear recording density curve relating to the heat energy.

5. The thermal printing method as claimed in claim 4, wherein said corrected power conduction time is converted into said corrected heating data in step D in accordance with a conversion curve which is an inverse function to the non-linear conversion curve for step B.

6. The thermal printing method as claimed in claim 5, wherein step E comprises a step of outputting a series of fractional power conduction times of varying lengths during recording one line, each of said fractional power conduction times being necessary for one increment from a corresponding one of a predetermined number of tonal levels available for said corrected heating data, the lengths of said fractional power conduction times varying in accordance with gradient of the non-linear recording density curve, and wherein said corrected power conduction time corresponding to said second tonal level is provided as a succession of the fractional power conduction times predetermined for respective tonal levels from a lowest to said second tonal level.

7. The thermal printing method as claimed in claim 1, wherein said original heating data is L-bit data and for representing a third number of tonal levels, and said corrected heating data is K-bit data, K being greater than L, and is for representing a fourth number of said tonal levels that is more than the third number, in correspondence with a larger variety of corrected power conduction times than the available tonal levels of the original heating data.

8. The thermal printing method as claimed in claim 1, for use with a thermosensitive recording sheet, wherein said original heating data includes bias date and image data, said bias data being for heating said thermosensitive recording sheet up to a degree immediately before coloring, said image data being for coloring said thermosensitive recording sheet up to said first tonal level, and wherein both of said bias data and said image data are processed in steps B, C and D to obtain corrected bias data and corrected image data, and step E comprises the steps of:

driving said one heating element by said corrected bias data; and driving, thereafter, said one heating element by said corrected image data.

9. A thermal printing method using a thermal head having a plurality of heating elements arranged in line, wherein the heating elements are resistors which generate heat energy increasing in proportion to power conduction time therethrough, and are each individually driven in accordance with bias data for a bias heating time that is a constant power conduction time for heating said thermosensitive recording sheet up to a degree immediately before coloring and, thereafter, in accordance with image data assigned thereto for a gradation heating time that is a variable power conduction time for coloring said thermosensitive recording sheet up to a variable tonal level, the method comprising the steps of:

A. assigning original image data representative of a first tonal level to one of the heating elements;

B. converting said image data into time data representative of a total power conduction time as a sum of said bias heating time and said gradation heating time corresponding to said first tonal level;

C. correcting said time data to obtain a corrected total power conduction time;

D. converting said corrected total power conduction time into corrected image data which represents a second tonal level corresponding to a corrected gradation heating time that is determined by a difference between said corrected total power conduction time and said bias heating time;

E. driving said one heating element for said bias heating time by said bias data; and F. driving, thereafter, said one heating element for said corrected gradation heating time by said corrected image data.

10. The thermal printing method as claimed in claim 9, wherein said time data is corrected in step C by use of time data obtained from previous image data and from image data assigned to adjacent ones of the heating elements, so as to eliminate influence of heat accumulation in the heating elements on a recording density.

11. The thermal printing method as claimed in claim 9, wherein said time data is corrected in step C on a basis of resistance values of the heating elements, so as to eliminate influence of a resistance variation between the heating elements.

12. The thermal printing method as claimed in claim 9, wherein said image data is converted into said time data in step B in accordance with a non-linear conversion curve which is determined by a non-linear recording density curve relating to the heat energy.

13. The thermal printing method as claimed in claim 12, wherein said corrected total power conduction time is converted into said corrected image data in step D in accordance with a conversion curve which is an inverse function to the non-linear conversion curve for step B.

14. The thermal printing method as claimed in claim 13, wherein a fractional power conduction time necessary for one increment from a corresponding one of a predetermined number of available tonal levels, said fractional power conduction times having varying lengths in accordance with gradient of the non-linear recording density curve, and wherein said corrected gradation heating time corresponding to said second tonal level is provided as a succession of those fractional power conduction times predetermined for respective tonal levels from a lowest to said second tonal level.

15. A thermal printer using a thermal head having a plurality of heating elements arranged in line, wherein the heating elements are resistors which generate heat energy increasing in proportion to power conduction time therethrough, and are driven for different power conduction times to record dots at different densities, the thermal printer comprising:

a first look-up table memory for converting original heating data into time data representative of a power conduction time corresponding to said original heating data;

correction means for correcting said time data to obtain a corrected power conduction time;

a second look-up table memory for converting said corrected power conduction time into corrected heating data which corresponds to said corrected power conduction time; and driving means for driving the heating elements in accordance with said corrected heating data.

16. The thermal printer as claimed in claim 15, wherein said correction means corrects said time data in accordance with time data obtained from previous heating data and from heating data of adjacent pixels, so as to eliminate influence of heat accumulation in the heating elements on a recording density, and on a basis of resistance values of the heating elements, so as to eliminate influence of a resistance variation between the heating elements.

17. The thermal printer as claimed in claim 15, wherein said first look-up table memory represents a non-linear conversion curve which is determined by a non-linear recording density curve relating to the heat energy.

18. The thermal printer as claimed in claim 17, wherein said second look-up table memory represents a conversion curve which is an inverse function to the non-linear conversion curve of the first look-up table.

19. The thermal printer as claimed in claim 15, further comprising means for outputting a series of fractional power conduction times of varying lengths to said driving means during recording one line, each of said fractional power conduction times being necessary for one increment from a corresponding one of a predetermined number of available tonal levels, the lengths of said fractional power conduction times varying in accordance with gradient of a non-linear recording density curve, wherein said corrected power conduction time is provided as a succession of a number of said fractional power conduction times that is determined by said corrected heating data.

20. The thermal printer as claimed in claim 15, wherein said original heating data is L-bit data and is for representing a first number of tonal levels, and said corrected heating data is K-bit data, K being greater than L, and is for representing a second number of said tonal levels that is more than the third number, in correspondence with a larger variety of corrected power conduction times than the available tonal levels of the original heating data.

21. A thermal printer using a thermal head having a plurality of heating elements arranged in line, wherein the heating elements are resistors which generate heat energy increasing in proportion to power conduction time therethrough, and are each individually driven in accordance with bias data and image data assigned thereto, said bias data being representative of a bias heating time that is a constant power conduction time for heating said thermosensitive recording sheet up to a degree immediately before coloring, said image data being representative of a gradation heating time that is a variable power conduction time for coloring said thermosensitive recording sheet up to a variable tonal level:

a first look-up table memory for converting original image data into time data representative of a total power conduction time as a sum of said bias heating time and a gradation heating time corresponding to said original image data;

correction means for correcting said time data to obtain said corrected total power conduction time;

a second look-up table memory for converting said corrected total power conduction time into corrected image data which corresponds to a corrected gradation heating time that is determined by a difference between said corrected total power conduction time and said bias heating time; and driving means for driving the heating elements each individually for said bias heating time in accordance with said bias data and, thereafter, for said corrected gradation heating time in accordance with said corrected image data.

* * * * *